US008012656B2

(12) United States Patent
Wu et al.

(10) Patent No.: US 8,012,656 B2
(45) **Date of Patent: *Sep. 6, 2011**

(54) BACKING LAYER CONTAINING PHOTOCONDUCTOR

(75) Inventors: Jin Wu, Webster, NY (US); Lanhui Zhang, Webster, NY (US); Lin Ma, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 698 days.

This patent is subject to a terminal disclaimer.

(21) Appl. No.: 12/129,952

(22) Filed: May 30, 2008

(65) Prior Publication Data

US 2009/0297963 A1 Dec. 3, 2009

(51) Int. Cl.
*G03G 15/02* (2006.01)

(52) U.S. Cl. ..... 430/58.8; 430/60; 430/63; 430/523; 430/930

(58) Field of Classification Search ..... 430/60, 430/63, 133, 523, 930, 58.8
See application file for complete search history.

(56) References Cited

U.S. PATENT DOCUMENTS

| | | | | |
|---|---|---|---|---|
| 4,654,284 | A | 3/1987 | Yu et al. | |
| 5,021,309 | A | 6/1991 | Yu | |
| 5,069,993 | A | 12/1991 | Robinette et al. | |
| 5,096,795 | A | 3/1992 | Yu | |
| 5,919,590 | A | 7/1999 | Yu et al. | |
| 5,935,748 | A | 8/1999 | Yu et al. | |
| 6,303,254 | B1 | 10/2001 | Yu et al. | |
| 6,528,226 | B1 | 3/2003 | Yu et al. | |
| 6,913,863 | B2 | 7/2005 | Wu et al. | |
| 6,939,652 | B2 | 9/2005 | Yu | |
| 7,781,133 | B2 * | 8/2010 | Wu et al. | 430/58.8 |
| 2008/0003513 | A1 * | 1/2008 | Yanus et al. | 430/58.05 |
| 2008/0107979 | A1 | 5/2008 | Yanus et al. | |
| 2008/0107983 | A1 | 5/2008 | Yanus et al. | |
| 2008/0107984 | A1 | 5/2008 | Yanus et al. | |
| 2008/0107985 | A1 | 5/2008 | Yanus et al. | |
| 2009/0208858 | A1 * | 8/2009 | Wu et al. | 430/58.8 |
| 2009/0297232 | A1 | 12/2009 | Wu | |
| 2009/0297961 | A1 | 12/2009 | Wu | |
| 2009/0297962 | A1 | 12/2009 | Wu | |
| 2009/0297964 | A1 | 12/2009 | Wu | |
| 2009/0297965 | A1 | 12/2009 | Wu | |
| 2009/0297966 | A1 | 12/2009 | Wu | |
| 2009/0297967 | A1 | 12/2009 | Wu | |
| 2009/0297968 | A1 | 12/2009 | Wu | |
| 2009/0297969 | A1 | 12/2009 | Wu | |

OTHER PUBLICATIONS

Jin Wu et al., U.S. Appl. No. 12/033,247 on Anticurl Backside Costing (ACBC) Photoconductors, filed Feb. 19, 2008.
Jin Wu et al., U.S. Appl. No. 12/033,267 on Overcoat Containing Fluorinated Poly(Oxetane) Photoconductors, filed Feb. 19, 2008.
Jin Wu et al., U.S. Appl. No. 12/033,276 on Overcoated Photoconductors, filed Feb. 19, 2008.
Jin Wu et al., U.S. Appl. No. 11/961,549 on Photoconductors Containing Ketal Overcoats, filed Dec. 20, 2007.
Mohamed I. Abu-Abed et al., U.S. Appl. No. 11/768,318 on Imaging Member, filed Jun. 26, 2007.
Jin Wu et al., U.S. Appl. No. 11/729,622 on Anticurl Backside Coating (ACBC) Photoconductors, filed Mar. 29, 2007.

* cited by examiner

*Primary Examiner* — Thorl Chea
(74) *Attorney, Agent, or Firm* — Oliff & Berridge, PLC

(57) ABSTRACT

A photoconductor that includes, for example, a backing layer, a supporting substrate, a photogenerating layer, and a charge transport layer, and wherein the outermost layer of the backing layer is comprised of an acrylic resin and a crosslinkable fluoro additive.

29 Claims, No Drawings

BACKING LAYER CONTAINING PHOTOCONDUCTOR

CROSS REFERENCE TO RELATED APPLICATIONS

U.S. application Ser. No. 12/129,958, U.S. Publication No. 20090297964 on Anthracene Containing Photoconductors, filed May 30, 2008, the disclosure of which is totally incorporated herein by reference.

U.S. application Ser. No. 12/129,965, U.S. Publication No. 20090297965 on Ferrocene Containing Photoconductors, filed May 30, 2008, the disclosure of which is totally incorporated herein by reference.

U.S. Application No. 12/129,969, now U.S. Publication No. 20090297966 on Amine Phosphate Containing Photogenerating Layer Photoconductors, filed May 30, 2008, the disclosure of which is totally incorporated herein by reference.

U.S. application Ser. No. 12/129,943, U.S. Publication No. 20090297961 on Phenol Polysulfide Containing Photogenerating Layer Photoconductors, filed May 30, 2008, the disclosure of which is totally incorporated herein by reference.

U.S. application Ser. No. 12/129,977, U.S. Publication No. 20090297967 on Phosphonate Hole Blocking Layer Photoconductors, filed May 30, 2008, the disclosure of which is totally incorporated herein by reference.

U.S. application Ser. No. 12/129,948, U.S. Publication 20090297962 on Aminosilane and a Self Crosslinking Acrylic Resin Hole Blocking Layer Photoconductors, filed May 30, 2008, the disclosure of which is totally incorporated herein by reference.

U.S. application Ser. No. 12/129,982, U.S. Publication No. 20090297968 on Zirconocene Containing Photoconductors, filed May 30, 2008, the disclosure of which is totally incorporated herein by reference.

U.S. application Ser. No. 12/129,898, U.S. Publication 20090297969 on Polymer Anticurl Backside Coating (ACBC) Photoconductors, filed May 30, 2008, the disclosure of which is totally incorporated herein by reference.

U.S. application Ser. No. 12/129,995, U.S. Publication No. 20090297232 on Polyimide Intermediate Transfer Components, filed May 30, 2008, the disclosure of which is totally incorporated herein by reference.

In copending U.S. Application No. 12/033,279, now U.S. Pat. No. 7,781,133, filed Feb. 19, 2008 entitled Backing Layer Containing Photoconductor, the disclosure of which is totally incorporated herein by reference, there is illustrated a photoconductor comprising a substrate, an imaging layer thereon, and a backing layer located on a side of the substrate opposite the imaging layer wherein the outermost layer of the backing layer adjacent to the substrate is comprised of a self crosslinked acrylic resin and a crosslinkable siloxane component.

In U.S. application Ser. No. 12/033,247, now U.S. Pat. No. 7,771,908, filed Feb. 29, 2008, entitled Anticurl Backside Coating (ACBC) Photoconductors, the disclosure of which is totally incorporated herein by reference, discloses a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a fluorinated poly(oxetane) polymer.

U.S. application Ser. No. 12/033,267, now U.S. Pat. No. 7,776,499, filed Feb. 29, 2008, entitled Overcoat Containing Fluorinated Poly(Oxetane) Photoconductors, the disclosure of which is totally incorporated herein by reference, discloses a photoconductor comprising a supporting substrate, a photogenerating layer, and at least one charge transport layer comprised of at least one charge transport component, and in contact with the charge transport layer an overcoat layer comprised of a polymer, an optional charge transport component, and a fluorinated poly(oxetane) polymer.

U.S. application Ser. No. 12/033,276, now U.S. Pat. No. 7,771,907, filed Feb. 29, 2008, entitled Overcoated Photoconductors, the disclosure of which is totally incorporated herein by reference, discloses a photoconductor comprising an optional supporting substrate, a photogenerating layer, and at least one charge transport layer, and wherein at least one charge transport layer contains at least one charge transport component; and an overcoating layer in contact with and contiguous to the charge transport layer, and which overcoating is comprised of a self crosslinked acrylic resin, a charge transport component, and a low surface energy additive.

The following related photoconductor applications are also being recited. The disclosures of each of the following copending applications are totally incorporated herein by reference.

U.S. application Ser. No. 11/593,875, U.S. Publication No. 20080107985, now U.S. Pat. No. 7,799,497, filed Nov. 7, 2006 on Silanol Containing Overcoated Photoconductors, which discloses an imaging member comprising an optional supporting substrate, a silanol containing photogenerating layer, and at least one charge transport layer comprised of at least one charge transport component and an overcoating layer in contact with and contiguous to the charge transport, and which overcoating is comprised of an acrylated polyol, a polyalkylene glycol, a crosslinking agent, and a charge transport component.

U.S. application Ser. No. 11/593,657, U.S. Publication No. 20080107984, now U.S. Pat. No. 7,785,756, filed Nov. 7, 2006 on Overcoated Photoconductors With Thiophosphate Containing Charge Transport Layers, which discloses, for example, an imaging member comprising an optional supporting substrate, a photogenerating layer, and at least one charge transport layer, and wherein at least one charge transport layer contains at least one charge transport component and at least one thiophosphate; and an overcoating layer in contact with and contiguous to the charge transport layer, and which overcoating is comprised of an acrylated polyol, a polyalkylene glycol, a crosslinking component, and a charge transport component.

U.S. application Ser. No. 11/593,656, U.S. Publication No. 20080107979, now U.S. Pat. No. 7,781,132, filed Nov. 7, 2006 on Silanol Containing Charge Transport Overcoated Photoconductors, which discloses an imaging member comprising an optional supporting substrate, a photogenerating layer, and at least one charge transport layer comprised of at least one charge transport component and at least one silanol; and an overcoating in contact with and contiguous to the charge transport layer, and which overcoating is comprised of an acrylated polyol, a polyalkylene glycol, a crosslinking component, and a charge transport component.

U.S. application Ser. No. 11/593,662, U.S. Publication No. 20080107983, now U.S. Pat. No. 7,785,757, filed Nov. 7, 2006 on Overcoated Photoconductors with Thiophosphate Containing Photogenerating Layer, which discloses an imaging member comprising an optional supporting substrate, a photogenerating layer, and at least one charge transport layer, and wherein the photogenerating layer contains at least one thiophosphate, and an overcoating layer in contact with and contiguous to the charge transport layer, and which overcoating is comprised of an acrylated polyol, a polyalkylene glycol, a crosslinking component, and a charge transport component.

U.S. application Ser. No. 11/961,549, now U.S. Pat. No. 7,855,039, filed Dec. 20, 2007 on Photoconductors Containing Ketal Overcoats, discloses a photoconductor comprising a supporting substrate, a photogenerating layer, and at least one charge transport layer comprised of at least one charge transport component, and an overcoat layer in contact with and contiguous to the charge transport layer, and which overcoat is comprised of a crosslinked polymeric network, an overcoat charge transport component, and at least one ketal.

There is disclosed in copending U.S. application Ser. No. 11/768,318, now U.S. Pat. No. 7,691,551, filed Jun. 26, 2007, entitled Imaging Member, an imaging member comprising a substrate, an imaging layer thereon, and a crack-deterring backing layer located on a side of the substrate opposite the imaging layer; wherein the crack-deterring backing layer comprises a backing material selected from the group consisting of vinyl, polyethylene, polyimide, acrylic, paper, canvas, and a silicone.

There is disclosed in copending U.S. application Ser. No. 11/729,622, now U.S. Pat. No. 7,662,525, filed Mar. 29, 2007, entitled Anticurl Backside Coating (ACBC) Photoconductors, a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a polymer and needle shaped particles with an aspect ratio of from 2 to about 200.

BACKGROUND

Curl occurs in layered photoreceptors primarily since each layer has a different thermal contraction coefficient or because of shrinkage during the fabrication process. In particular, the charge transport layer usually has a higher contraction coefficient than the photoconductor supporting substrate. In forming the imaging member, the charge transport layer may be formed from a solution which is then heated or otherwise dried. As a result of the mismatch, the higher contraction coefficient causes the imaging member to curl as the imaging member cools from the higher drying temperature down to ambient temperature. The anticurl backside coating (ACBC) layer is applied to flatten or substantially flatten the substrate.

In embodiments, the photoconductors disclosed herein include an ACBC layer on the reverse side of the supporting substrate of a belt photoreceptor. The ACBC layer, which can be solution coated, such as for example, as a self-adhesive layer on the reverse side of the substrate of the photoreceptor, may comprise a number of suitable materials such as those components that may not substantially effect surface contact friction reduction, and prevents or minimizes wear/scratch problems for the photoreceptor device. In embodiments, the mechanically robust ACBC layer of the present disclosure usually will not substantially reduce the layer's thickness over extended time periods thereby adversely effecting its anticurling ability for maintaining effective imaging member belt flatness, for example when not flat, the ACBC layer may, but not necessarily will, cause undesirable upward belt curling which adversely impacts imaging member belt surface charging uniformity causing print defects which thereby prevent the imaging process from continuously allowing a satisfactory copy printout quality. Moreover, ACBC wear also produces dirt and debris resulting in a dusty machine operation condition. Since the ACBC layer is located on the reverse side of the photoconductor, it does not usually adversely interfere with the xerographic performance of the photoconductor, and decouples the mechanical performance from the electrical performance of the photoconductor.

Moreover, high surface contact friction of the ACBC layer against the machine, such as printers, subsystems can cause the development of undesirable electrostatic charge buildup. In a number of instances, with devices, such as printers, the electrostatic charge builds up because of high contact friction between the ACBC layer and the backer bars which increases the frictional force to the point that it requires higher torque from the driving motor to pull the belt for an effective cycling motion. In a full color electrophotographic apparatus, using a 10-pitch photoreceptor belt, this electrostatic charge build-up can be high due to the large number of backer bars used in the apparatus.

The present disclosure relates generally to electrophotographic imaging members, inclusive of photoconductors. More specifically, the present disclosure relates to photoconductors having enhanced durability, and as compared to a known polytetrafluoroethylene doped ACBC layer, a slippery surface, a higher bulk conductivity, and excellent mechanical wear characteristics, and where the ACBC layer is located on the side of the substrate opposite that of the imaging layers. Also, the ACBC layer of the present disclosure possesses in embodiments resistance to airborne chemical contaminants, which can decrease the photoconductor service life. Typical chemical contaminants include solvent vapors, environment airborne pollutants, and corona species emitted by machine charging subsystems such as ozone. Further, the photoconductor in a xerographic system is subjected to constant mechanical interactions against various subsystems, a disadvantage minimized with the photoconductors disclosed.

The ACBC layer in embodiments can be comprised of two layers or be a single layer structure. In the two layer structure, the bottom layer adjacent to the substrate provides anticurl functionality, and the top layer adjacent to the bottom layer provides wear resistance, slippery surface, and antistatic properties.

A number of backing layer formulations are disclosed in U.S. Pat. Nos. 5,069,993; 5,021,309; 5,919,590; 4,654,284 and 6,528,226. One known ACBC design can include an insulating polymer coating containing additives, such as silica or TEFLON®, to reduce friction against backer plates and rollers, but these additives tend to charge up triboelectrically due to rubbing resulting in electrostatic drag force that adversely impacts the process speed of the photoconductor.

References

Photoconductors containing ACBC layers are illustrated in U.S. Pat. Nos. 4,654,284; 5,096,795; 5,919,590; 5,935,748; 5,069,993; 5,021,309; 6,303,254; 6,528,226; and 6,939,652.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer.

In U.S. Pat. No. 4,587,189, the disclosure of which is totally incorporated herein by reference, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members or photoconductors of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises as a first step hydrolyzing a gallium phthalocyanine precursor pigment by dissolving the hydroxygallium phthalocyanine in a strong acid, and then reprecipitating the resulting dissolved pigment in basic aqueous media.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, such as the supporting substrates, the photogenerating layer components, the charge transport layer components, the overcoating layer components, and the like, of the above-recited patents may be selected for the photoconductors of the present disclosure in embodiments thereof.

Embodiments

There are disclosed in various embodiments herein, compositions, which when used on the reverse side of a substrate, provide anticurl, wear resistance, slippery surface characteristics, antistatic properties, and other advantages as illustrated herein to the imaging layer or layers. As the coating is positioned on the underside of the substrate, it usually does not interfere with the electrical properties of the imaging member. Thus, the mechanical performance of the outermost exposed layer on the backside of the substrate is separated from the electrical properties of the imaging layers.

Aspects of the present disclosure relate to a photoconductor comprising a substrate, an imaging layer thereon, and a backing layer located on a side of the substrate opposite the imaging layer wherein the outermost layer of the backing layer adjacent to the substrate is comprised of a self crosslinked acrylic resin and a crosslinkable or crosslinked fluoro additive; a photoconductor comprised of a single backing layer, thereover a supporting substrate, a photogenerating layer, a charge transport layer, and wherein the backing layer is comprised of a crosslinked acrylic resin and a crosslinkable fluoro additive; a photoconductor comprised of a first backing layer and thereover a second backing layer; and in sequence thereover a supporting substrate, a photogenerating layer, a charge transport layer, and wherein the first layer of the backing layer is adjacent to the substrate and is comprised of a polycarbonate, and the second layer of the backing layer is situated on top of the first layer, and is comprised of an acrylic resin, a crosslinkable fluoro additive, and an acid catalyst.

Embodiments include a photoconductor comprising a substrate, an imaging layer thereon, and an ACBC layer located on a side of the substrate opposite to the imaging layer, wherein the ACBC layer comprises at least one single layer, such as two layers, and the single layer or the top layer of the two layers, or the outermost exposed layer comprises a backing material of a self crosslinked acrylic resin and a crosslinkable fluoro additive or component. Also, in embodiments the ACBC layer can have added thereto an acid catalyst, such as p-toluenesulfonic acid (pTSA), which catalyst functions primarily to assure a full cure or from about 95 to 100 percent crosslinking.

In various embodiments, the ACBC layer has a thickness of from about 1 to about 100, from about 5 to about 50, or from about 10 to about 30 microns. A single layer ACBC layer has a thickness of from about 1 to about 100, from about 5 to about 50, or from about 10 to about 30 microns. In a two layer ACBC layer, the bottom layer adjacent to the substrate has a thickness of from about 0.9 to about 99.9, from about 5 to about 50, or from about 10 to about 30 microns, and the top layer has a thickness of from about 0.1 to about 20, from about 1 to about 10, or from about 2 to about 6 microns.

Embodiments also further include an image forming apparatus for forming images on a recording medium comprising (a) a photoreceptor or photoconductor member to receive an electrostatic latent image thereon, wherein the photoreceptor member comprises a substrate, an imaging layer on a first side of the substrate, and the crosslinked resin disclosed herein, anticurl backside coating (ACBC) layer on a second side of the substrate; (b) a development component to develop the electrostatic latent image to form a developed image on the photoreceptor member; (c) a transfer component for transferring the developed image from the photoreceptor member to another member or a copy substrate; and (d) a fusing member to fuse the developed image to the other member or the copy substrate.

Aspects of the present disclosure relate to a photoconductor comprising a substrate, an imaging layer thereon, and a backing layer located on a side of the substrate opposite the imaging layer wherein the outermost layer of the backing layer adjacent to the substrate or the lower layers of the backing layer is comprised of a self crosslinked acrylic resin and a crosslinkable fluoro additive component; a photoconductor wherein the backing layer is a single layer of a self crosslinked acrylic resin, and a crosslinkable fluoro additive, and where the backing layer is of a thickness of from about 1 to about 30 microns; a photoconductor wherein the backing layer is comprised of a first and second layer, the first layer being adjacent to the substrate, the first layer being comprised of a polymer selected from a group consisting of polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof with a thickness of from about 1 to about 50 microns; and wherein the second layer is situated on top of the first layer, and which second layer is comprised of a crosslinked acrylic resin and a crosslinkable or crosslinked fluoro additive with a thickness of from about 0.1 to about 30 microns; a photoconductor wherein the first layer is comprised of a polycarbonate, and has a thickness of from about 10 to about 30 microns, and the second layer is comprised of an acrylic resin and a crosslinkable fluoro additive, and has a thickness of from about 1 to about 10 microns; a photoconductor wherein the backing layer further includes an adhesive layer with a thickness of from about 0.01 to about 1 micron comprised of a material selected from the group consisting of silicone, rubber, and an acrylic resin situated between the substrate and the backing layer; a photoconductor wherein the crosslinkable acrylic resin possesses a bulk resistivity at about 20° C. and at about 50 percent humidity of from about $10^8$ to about $10^{14}$ Ωcm, a weight average molecular weight ($M_w$) of from about 100,000 to about 500,000, and a polydispersity index (PDI) ($M_w/M_n$) of from about 1.5 to about 4; a photoconductor wherein the self crosslinkable acrylic resin possesses a bulk resistivity at 20° C. and 50 percent humidity of from about $10^9$ to about $10^{12}$ Ωcm, a weight average molecular weight ($M_w$) of from about 120,000 to about 200,000, and a polydispersity index (PDI) ($M_w/M_n$) of from about 2 to about 3; a photoconductor wherein examples of the fluoro additive component are as illustrated herein; a photoconductor wherein the acrylic resin is present in an amount of from about 60 to about 99.9 percent, and the fluoro additive is present in an amount of from about 0.1 to about 40 weight percent, and wherein the total thereof is about 100 percent; a photoconductor wherein the layer further includes an acid catalyst selected in an amount of from about 0.01 to about 5 weight percent; a photoconductor wherein the acid catalyst is a toluenesulfonic acid selected in an amount of from about 0.1 to about 2 weight percent; a photoconductor comprised of a single layer backing layer, thereover a supporting substrate, a photogenerating layer, a charge transport layer, and wherein the backing layer is comprised of a self crosslinked acrylic resin and a crosslinkable fluoro additive component; a photoconductor comprised of a first backing layer and thereover a second backing layer, thereover a supporting substrate, a photogenerating layer, a charge transport layer, and wherein the first layer of the backing layer is adjacent to the substrate and is comprised of a polycarbonate, and the second layer of the backing layer is situated on top of the first layer, and is comprised of a crosslinked acrylic resin, a crosslinked fluoro additive component and an acid catalyst; a photoconductor wherein the imaging layer is comprised of a photogenerating layer, and at least one charge transport layer comprised of at least one charge transport component; a photoconductor wherein the charge transport component is comprised of at least one of aryl amine molecules

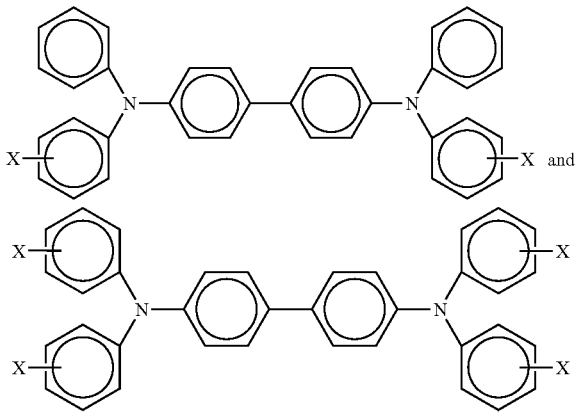

wherein X is selected from the group consisting of at least one of alkyl, alkoxy, aryl, and halogen; a photoconductor wherein the charge transport component is comprised of

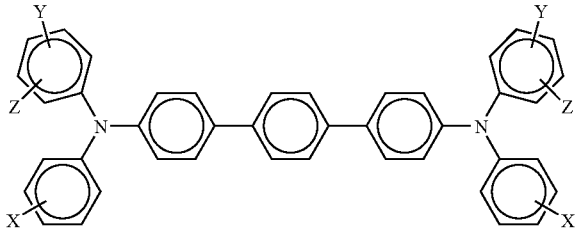

wherein X, Y and Z are independently selected from the group consisting of at least one of alkyl, alkoxy, aryl, and halogen; a photoconductor wherein the charge transport component is an aryl amine selected from the group consisting of N,N'-bis(4-butvlphenyl)-N,N'di-p-tolyl-[p-terphenyl]-4,4'-diamine, N,N'-bis(4-butylphenyl) -N,N'-di-m-tolyl-[p-terphenyl]-4,4'-diamine, N, N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2 -ethyl-6-methylphenyl)-[p-terphenyl]-4,4'-diamine, N,N'-bis(4-butylphenyl)- N,N-bis-(2,5-dimethylphenyl)-[p-terphenyl]-4,4'-diamine, N,N'-diphenyl-N,N'-bis (3-chlorophenyl)-[p-terphenyl]-4,4'-diamine, and optionally mixtures thereof; a photoconductor wherein the charge transport component is comprised of aryl amine mixtures; a photoconductor wherein the imaging layer further includes in at least one of the charge transport layers an antioxidant comprised of a hindered phenolic and a hindered amine; a photoconductor wherein the photogenerating layer is comprised of a photogenerating pigment or photogenerating pigments; a photoconductor wherein the photogenerating pigment is comprised of at least one of a metal phthalocyanine, metal free phthalocyanine, a perylene, and mixtures thereof; a photoconductor further including a hole blocking layer, and an adhesive layer, and wherein the substrate is comprised of a conductive material; a photoconductor wherein the at least one charge transport layer is from 1 to about 4 layers; and a photoconductor wherein the substrate is a flexible web.

Examples of the ACBC Layer Components

Embodiments include a photoconductor comprising a substrate, an imaging layer thereon, and an ACBC layer located on a side of the substrate opposite to the imaging layer wherein the ACBC layer comprises a single layer or is a two layer structure, and the single layer or the top layer of the two layer structure or the outermost exposed layer comprises a backing material of a self crosslinked acrylic resin and a crosslinkable fluoro additive agent or component.

In a two layer ACBC structure, the first or bottom layer adjacent to the substrate comprises a polymer selected, for example, from the group consisting of polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl) carbonate (also referred to as bisphenol-C-polycarbonate), mixtures thereof, and the like. In embodiments, the polymer binder is comprised of a polycarbonate resin with a weight average molecular weight of from about 20,000 to about 100,000, and more specifically, with a weight average molecular weight $M_w$ of from about 50,000 to about 100,000. The second or top layer on top of the first or bottom layer comprises a backing material of a self crosslinked acrylic resin, and a crosslinkable fluoro additive agent or component.

The ACBC layer disclosed, and which layer possesses in embodiments the advantages as illustrated herein, and more specifically, which outermost exposed layer has characteristics of being antistatic, slippery, chemical resistant, and scratch resistant primarily in view of the crosslinked polymeric layer, comprises a self crosslinked acrylic resin, a crosslinkable fluoro additive, and a catalyst.

Examples of the crosslinked acrylic resin include a self crosslinked acrylic resin with a weight average molecular weight ($M_w$) of from about 100,000 to about 500,000, or from about 120,000 to about 200,000; a polydispersity index (PDI) ($M_w/M_n$) of from about 1.5 to about 4, or from about 2 to about 3; and a bulk resistivity (20° C. and 50 percent humidity) of from about $10^8$ to about $10^{14}$ Ωcm, or from about $10^9$ to about $10^{12}$ Ωcm.

A specific example of the crosslinked acrylic resin, which forms a crosslinked polymeric network within itself upon thermal curing, includes DORESCO® TA22-8 obtained from Lubrizol Dock Resins, Linden, N.J., which resin possesses, it is believed, a weight average molecular weight of about 160,000, a polydispersity index of about 2.3, and a bulk resistivity (20° C. and 50 percent humidity) of about $10^{11}$ Ωcm. Other examples include DORESCO® TA22-51, also obtained from Lubrizol Dock Resins, with a crosslink density lower than that of DORESCO® TA22-8.

Examples of the crosslinkable fluoro additive include (1) hydroxyl derivatives of perfluoropolyoxyalkanes such as FLUOROLINK® D (M.W. of about 1,000 and a fluorine content of about 62 percent), FLUOROLINK® D10-H (M.W. of about 700 and fluorine content of about 61 percent), and FLUOROLINK® D10 (M.W. of about 500 and fluorine content of about 60 percent) (functional group —$CH_2OH$); FLUOROLINK® E (M.W. of about 1,000 and a fluorine content of about 58 percent), and FLUOROLINK® E10 (M.W. of about 500 and fluorine content of about 56 percent) (functional group —$CH_2(OCH_2CH_2)_nOH$); FLUOROLINK® T (M.W. of about 550 and fluorine content of about 58 percent), and FLUOROLINK® T10 (M.W. of about 330 and fluorine content of about 55 percent) (functional group —$CH_2OCH_2CH(OH)CH_2OH$); (2) hydroxyl derivatives of perfluoroalkanes ($R_fCH_2CH_2OH$, wherein $R_f$═F$(CF_2CF_2)_n$) wherein n represents the number of groups, such as about 1 to about 50, such as ZONYL® BA (M.W. of about 460 and fluorine content of about 71 percent), ZONYL® BA-L (M.W. of about 440 and fluorine content of about 70 percent), ZONYL® BA-LD (M.W. of about 420 and fluorine content of about 70 percent), and ZONYL® BA-N (M.W. of about 530 and fluorine content of about 71 percent); (3) carboxylic acid derivatives of fluoropolyethers such as FLUOROLINK® C (M.W. of about 1,000 and fluorine content of about 61 percent); (4) carboxylic ester derivatives of fluoropolyethers such as FLUOROLINK® L (M.W. of about 1,000 and fluorine content of about 60 percent), FLUOROLINK® L10 (M.W. of about 500 and fluorine content of about 58 percent); (5) carboxylic ester derivatives of perfluoroalkanes ($R_fCH_2CH_2O(C{=}O)R$, wherein $R_f$═F$(CF_2CF_2)_n$, and n is as illustrated herein, and R is alkyl) such as ZONYL® TA-N (fluoroalkyl acrylate, R═$CH_2$═CH—, M.W. of about 570 and fluorine content of about 64 percent), ZONYL® TM (fluoroalkyl methacrylate, R═$CH_2$═C$(CH_3)$—, M.W. of about 530 and fluorine content of about 60 percent), ZONYL® FTS (fluoroalkyl stearate, R═$C_{17}H_{35}$—, M.W. of about 700 and fluorine content of about 47 percent), ZONYL® TBC (fluoroalkyl citrate, M.W. of about 1,560 and fluorine content of about 63 percent); (6) sulfonic acid derivatives of perfluoroalkanes ($R_fCH_2CH_2\ SO_3H$, wherein $R_f$═F$(CF_2CF_2)_n$), and n is as illustrated herein, such as ZONYL® TBS (M.W. of about 530 and fluorine content of about 62 percent); (7) ethoxysilane derivatives of fluoropolyethers such as FLUOROLINK® S10 (M.W. of about 1,750 to about 1,950); (8) phosphate derivatives of fluoropolyethers such as FLUOROLINK® F10 (M.W. of about 2,400 to about 3,100). The FLUOROLINK® additives are available from Ausimont USA, and the ZONYL® additives are available from E.I. DuPont.

The weight/weight ratio of the crosslinked acrylic resin and the fluoro additive component in the ACBC layer is from about 99.9/0.1 to about 50/50, from about 99.5/0.5 to about 80/20, or from about 99/1 to about 90/10.

Non-limiting examples of catalysts selected for the ACBC layer include oxalic acid, maleic acid, carboxylic acid, ascorbic acid, malonic acid, succinic acid, tartaric acid, citric acid, p-toluenesulfonic acid, methanesulfonic acid, and the like, and mixtures thereof. A typical concentration of acid catalyst is from about 0.01 to about 5 weight percent based on the weight of the crosslinked acrylic resin.

In other embodiments, the imaging member may further comprise an adhesive layer located on the reverse side of the substrate between the backing layer and the substrate. The adhesive layer may comprise an adhesive material selected from the group consisting of silicone, rubber, acrylic, and the like.

In embodiments, the adhesive layer and the backing layer may be applied together as a laminated self-adhesive. For example, commercial tapes normally comprise a backing and an adhesive. Exemplary commercial tapes that may be selected are vinyl tape, masking tape, or electrical tape. These types of tapes are distinguished by various features. A vinyl tape comprises a vinyl backing and an adhesive. Masking tape that may be selected comprises a paper backing and an adhesive. Electrical tape that may be selected comprises a vinyl backing and an adhesive. The electrical tape backing may be nonconducting, that is insulating, though this property is not required for crack resistance. The backing may also have an elastic property that is a reversible elastic elongation in the tensile direction. The electrical tape adhesive provides adhesion for long periods of time, such as from months to years.

The electrical tape adhesive may also be selected so as to preferentially adhere to the electrical tape backing, that is it sticks to the backing, not the surface to which the tape is applied. These types of tape are not mutually exclusive; for example a tape can be a vinyl tape and an electrical tape. When desired, multiple ACBC layers may be applied to the reverse side of the imaging member, and one or more laminated self-adhesive layers may be applied.

As the ACBC layer increases crack resistance in the imaging layers (the photogenerating and charge transport layers), the outermost exposed layer on the front side of the imaging member does not usually need to provide crack resistance. Thus, the composition of the charge transport layer or the overcoat layer can be optimized to increase scratch resistance. For example, an overcoat layer formed from a composition of an acrylic polyol binder, a melamine-formaldehyde curing agent, and a di-hydroxy biphenyl amine has excellent scratch resistance, but lacks somewhat in crack resistance properties. An example of an overcoat layer which is disclosed in U.S. patent application Ser. No. 11/275,546, U.S. Publication 20070166634 (Attorney Docket No. 20051247-US-NP), filed Jan. 13, 2006, the disclosure of which is totally incorporated herein by reference, could be used in conjunction with the ACBC layer of the present disclosure. These overcoat layers may also comprise (i) a hydroxyl containing polymer (polyesters and acrylic polyols); (ii) a melamine-formaldehyde curing agent; and (iii) a hole transport material. The presence of a co-binder in the overcoat layer is associated with improved crack resistance. A co-binder may not be required in an imaging member comprising the ACBC layer of the present disclosure.

The ACBC layer also, in embodiments, possesses high wear resistance. High wear resistance in the backing layer increases crack resistance in the imaging layer by preventing the formation of loose particulates that, when impacted between the substrate and the rollers in the imaging machine, produce cracks in the imaging layer or imaging layers.

Examples of the Photoconductor Layers

There can be selected for the photoconductors disclosed herein a number of known layers, such as substrates, photogenerating layers, charge transport layers, hole blocking layers, adhesive layers, protective overcoat layers, and the like. Examples, thicknesses, specific components of many of these layers include the following.

The thickness of the photoconductor substrate layer depends on many factors, including economical considerations, electrical characteristics, adequate flexibility, and the like, thus this layer may be of a substantial thickness, for example over 3,000 microns, such as from about 1,000 to about 2,000 microns, from about 500 to about 1,000 microns, or from about 300 to about 700 microns, ("about" throughout includes all values in between the values recited), or of a minimum thickness. In embodiments, the thickness of this layer is from about 75 microns to about 300 microns or from about 100 to about 150 microns.

The photoconductor substrate may be opaque or substantially transparent, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of a substantial thickness of, for example, up to many centimeters, or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the imaging members of the present disclosure, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations.

The photogenerating composition or pigment is present in the resinous binder composition in various amounts. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder, and fabricated by solvent coating techniques.

In embodiments, examples of polymeric binder materials that can be selected as the matrix for the photogenerating layer are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride, and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer, or interfacial layer, and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micron (500 Angstroms) to about 0.3 micron (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The hole blocking or undercoat layers for the imaging members of the present disclosure can contain a number of components including known hole blocking components, such as amino silanes, doped metal oxides, a metal oxide like titanium, chromium, zinc, tin, and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant, followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol, and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

A number of charge transport compounds can be included in the charge transport layer, which layer generally is of a thickness of from about 5 microns to about 75 microns, and more specifically, of a thickness of from about 10 microns to about 40 microns. Examples of charge transport components are aryl amines of the following formulas/structures

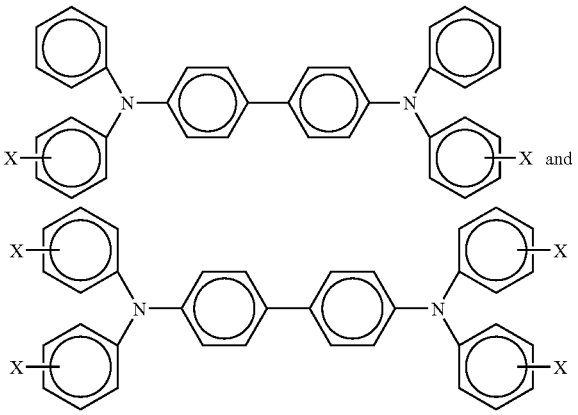

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas/structures

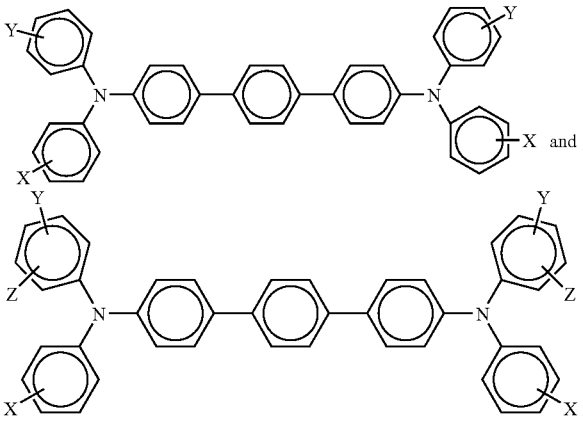

wherein X, Y and Z are independently alkyl, alkoxy, aryl, a halogen, or mixtures thereof; and wherein at least one of Y and Z are present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis (alkylphenyl)-1,1-biphenyl-4,4'-diamine wherein alkyl is selected from the group consisting of methyl, ethyl, propyl, butyl, hexyl, and the like; N,N'-diphenyl -N,N'-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4, 4'-diamine, N,N'-bis(4-butylphenyl)-N,N'-di-m-tolyl-[p-terphenyl]4,4'-diamine, N,N'-bis(4-butylphenyl)-N,N'-di-o-tolyl-[p-terphenyl]-4,4'-diamine, N,N'-bis(4-butylphenyl) -N,N'-bis-(4-isopropylphenyl)-[p-terphenyl]-4,4'-diamine, N,N'-bis (4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer, may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, "charge transport" refers, for example, to charge transporting molecules as a monomer that allows the free charge generated in the photogenerating layer to be transported across the transport layer.

Examples of hole transporting molecules present, for example, in an amount of from about 50 to about 75 weight percent, include, for example, pyrazolines such as 1-phenyl-3-(4'-diethylamine styryl)-5-(4"-diethylamino phenyl) pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p -tolyl-[p-terphenyl]-4,4'-diamine, N,N'-bis(4-butylphenyl)-N,N'-di-m-toyl-[p -terphenyl]4,4'diamine, N,N'bis(4-butylphenyl)-N,N'di-o-tolyl-[p-terphenyl]-4,4'-diamine, N,N'-bis(4-butylphenyl)-N,N'bis-(4-isopropylphenyl)-[p -terphenyl4,4'-diamine, N,N'-bis(4-butylphenyl)-N,N'-bis-(2-ethyl-6 -methylphenyl)-[p-terphenyl]-4,4'-diamine, N,N'-bis(4-butylphenyl)-N,N'-bis -2,5-dimethylphenyl)-[p-terphenyl]-4,4'-diamine, N,N'-diphenyl-N,N'-bis(3-chlorophenyl)-[p-terphenyl]-4,4'-diamine; hydrazones such as N-phenyl-N -methyl-3-(9-ethyl) carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p -toyl-[p-terphenyl]-4,4'-diamine, N,N'-bis(4-butylphenyl)-N,N'-di-m-tolyl-[p -terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p -terphenyl]-4,4'-diamine, N,N'-bis(4-butylphenyl)-N,N'-bis-(2-ethyl-6-methylPhenyl)-[p-terphenyl]-4,4'-diamine, N,N'-bis(4-butylphenyl)-N,N'-bis -(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material, or a combination of a small molecule charge transport material and a polymeric charge transport material.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate)methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ PS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layer in embodiments is from about 10 to about 70 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. An optional top overcoating layer, such as the overcoating of U.S. application Ser. No. 11/593,875, now U.S. Pat. No. 7,799,497, the disclosure of which is totally incorporated herein by reference, may be applied over the charge transport layer to provide abrasion protection.

Aspects of the present disclosure relate to a photoconductive imaging member comprised of a first ACBC layer, a supporting substrate, a photogenerating layer, a charge transport layer, and an overcoating charge transport layer; a photoconductive member with a photogenerating layer of a thickness of from about 0.1 to about 10 microns, and at least one transport layer, each of a thickness of from about 5 to about 100 microns; an imaging method and an imaging apparatus containing a charging component, a development component, a transfer component, and a fixing component, and wherein the apparatus contains a photoconductive imaging member comprised of a first layer, a supporting substrate, and thereover a layer comprised of a photogenerating pigment and a charge transport layer or layers, and thereover an overcoat charge transport layer, and where the transport layer is of a thickness of from about 40 to about 75 microns; a member wherein the photogenerating layer contains a photogenerating pigment present in an amount of from about 5 to about 95 weight percent; a member wherein the thickness of the photogenerating layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a hydroxygallium phthaiocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers comprises

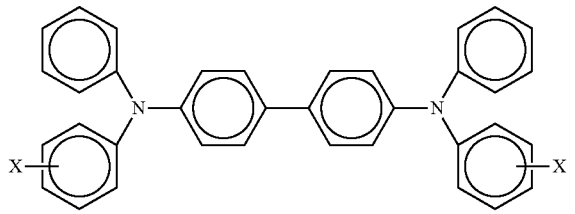

wherein X is selected from the group consisting of alkyl, alkoxy, aryl, and halogen, and more specifically methyl and chloro; an imaging member wherein alkyl and alkoxy contains from about 1 to about 12 carbon atoms; an imaging member wherein alkyl contains from about 1 to about 5 carbon atoms; an imaging member wherein alkyl is methyl; an imaging member wherein each of, or at least one of the charge transport layers comprises

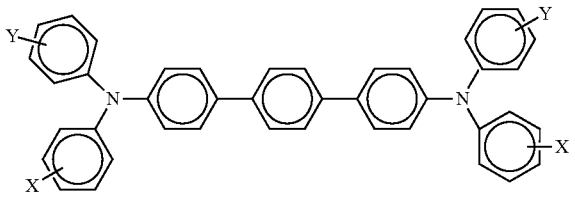

wherein X and Y are independently alkyl, alkoxy, aryl, a halogen, or mixtures thereof; an imaging member wherein alkyl and alkoxy contain from about 1 to about 12 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta)+/−0.2°) 7.4, 9.8, 12.4, 16.2, 17.6, 18.4, 21.9, 23.9, 25.0, 28.1 degrees, and the highest peak at 7.4 degrees; a method of imaging, which comprises generating an electrostatic latent image on an imaging member, developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the substrate and the charge transport layer; a member wherein the charge transport layer is situated between the substrate and the photogenerating layer; a member wherein the photogenerating layer is of a thickness of from about 0.1 to about 50 microns; a member wherein the photogenerating component amount is from about 0.5 weight percent to about 20 weight percent, and wherein the photogenerating pigment is optionally dispersed in from about 1 weight percent to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N.N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl) -N,N'-bis-(4-isopropylphenyl)-[p-terphenyl]-4,4'-diamine, N,N'-bis(4-butylphenyl)-N,N'-bis-(2-ethyl-6-methylphenyl)-[-p-terphenyl]-4,4'-diamine, N,N'-bis(4-butylphenyl)-N,N'-bis-(2,5-dimethylphenyl)-[p-terphenyl]4,4'-diamine, N,N'-diphenyl-N,N'-bis(3-chlorophenyl)-[p-terphenyl]-4,4'-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; a color method of imaging which comprises generating an electrostatic latent image on the imaging member, developing the latent image, transferring and fixing the developed electrostatic image to a suitable substrate; photoconductive imaging members comprised of a supporting substrate, a photogenerating layer, a hole transport layer and a top overcoating layer in contact with the hole transport layer, or in embodiments in contact with the photogenerating layer, and in embodiments wherein a plurality of charge transport layers are selected, such as for example, from two to about ten, and more specifically, two may be selected; and a photoconductive imaging member comprised of an optional supporting substrate, a photogenerating layer, and a first, second, and third charge transport layer. ground strip layer may have a thickness from about 7 to about 42 microns, and more specifically, from about 14 to about 23 microns.

The following Examples further define and describe embodiments herein. Unless otherwise indicated, all parts and percentages are by weight.

COMPARATIVE EXAMPLE 1

A controlled anticurl backside coating layer (ACBC) solution was prepared by introducing into an amber glass bottle in a weight ratio of 8:92 VITEL® 2200, a copolyester of isoterephthalic acid, dimethylpropanediol, and ethanediol having a melting point of from about 302° C. to about 320° C. (degrees Centigrade), commercially available from Shell Oil Company, Houston, Tex., and MAKROLON® 5705, a known polycarbonate resin having a $M_w$ molecular weight average of from about 50,000 to about 100,000, commercially available from Farbenfabriken Bayer A.G. The resulting mixture was then dissolved in methylene chloride to form a solution containing 9 percent by weight solids. This solution was applied on the back of a substrate, of a biaxially oriented polyethylene naphthalate substrate (KALEDEX™ 2000) having a thickness of 3.5 mils, to form a coating of the anticurl backside coating layer that upon drying (120° C. for 1 minute) had a thickness of 17.4 microns. During this coating process, the humidity was equal to or less than 15 percent, such as 10 percent; and thereover, a 0.02 micron thick titanium layer coated on a biaxially oriented polyethylene naphthalate substrate (KALEDEX™ 2000) having a thickness of 3.5 mils, and applying thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in the forced air dryer of a known coater device. The resulting hole blocking layer had a dry thickness of 500 Angstroms. An adhesive layer was then prepared by applying a wet coating over the blocking layer using a gravure applicator or an extrusion coater, and which adhesive contained 0.2 percent by weight based on the total weight of the solution of copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON™ 200 (PCZ-200) or POLYCARBONATE Z, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the known ground strip layer that was applied later. The photogenerating layer was dried at 120° C. for 1 minute in a forced air oven to form a dry photogenerating layer having a thickness of 0.4 micron.

The photoconductor imaging member web was then coated with two charge transport layers. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and poly(4,4'-isopropylidene diphenyl)carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than about 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process, the humidity was equal to or less than 15 percent.

COMPARATIVE EXAMPLE 2

A photoconductor was prepared by repeating the process of Comparative Example 1 except that the ACBC layer coating dispersion was prepared by adding polytetrafluoroethylene (PTFE) MP-1100 (E.I. DuPont) into the ACBC coating solution of Comparative Example 1, milling with 2 millimeter stainless shots at 200 rpm for 20 hours. The resulting ACBC coating dispersion had the formulation of VITEL® 2200/MAKROLON® 5705/PTFE MP-1100=7.3/83.6/9.1 in methylene chloride with 9.7 weight percent of the solid. The resulting dispersion was applied on the back of the substrate of a biaxially oriented polyethylene naphthalate substrate (KALEDEX™ 2000) having a thickness of 3.5 mils, to form a coating of the anticurl backside coating layer that upon drying (120° C. for 1 minute) had a thickness of 18.7 microns. During this coating process the humidity was equal to or less than 15 percent.

EXAMPLE I

A photoconductor was prepared by repeating the process of Comparative Example 1 except that the ACBC layer solution was prepared by introducing into an amber glass bottle in a weight ratio of 95:4:1 DORESCO® TA22-8, a self crosslinked acrylic resin obtained from Lubrizol Dock Resins, Linden, N.J.; the fluoropolymer FLUOROLINK® D (M.W. of about 1,000 and fluorine content of about 62 percent), a hydroxyl derivative of perfluoropolyoxyalkane; and p-toluenesulfonic acid (pTSA). The resulting mixture was then dissolved in methylene chloride to form a solution containing 7.8 percent by weight solids. This solution was then applied on the back of the substrate of the above biaxially oriented polyethylene naphthalate substrate (KALEDEX™ 2000) having a thickness of 3.5 mils, to form a coating of the anticurl backside coating layer comprised of the acrylic resin and the fluoro component, the acid with a ratio of 95/4/1 that upon drying (125° C. for 2 minutes) had a thickness of 15 microns.

EXAMPLE II

A photoconductor was prepared by repeating the process of Comparative Example 1 except that a 2 micron second layer was coated on top of the existing ACBC layer of Comparative Example 1 situated on the backside of the photoconductor. The second layer solution was prepared by introducing into an amber glass bottle in a weight ratio of 95:4:1 DORESCO® TA22-8, a self crosslinked acrylic resin obtained from Lubrizol Dock Resins, Linden, N.J.; and the fluoropolymer FLUOROLINK® D (M.W. of about 1,000 and fluorine content of about 62 percent), a hydroxyl derivative of perfluoropolyoxyalkane; and p-toluenesulfonic acid (pTSA). The resulting mixture was then dissolved in methylene chloride to form a solution containing 7.5 percent by weight solids. This solution was applied on top of the existing ACBC layer of Comparative Example 1 to form a coating comprised of the acrylic resin and the fluoro component, the acid with a ratio of 95/4/1 that upon drying (125° C. for 2 minutes) had a thickness of 2 microns.

Contact Angle Measurements

The advancing contact angles with deionized water on the ACBC layers of Comparative Examples 1 and 2, and Examples I and II photoconductors were measured at ambient temperature (about 23° C.), using the Contact Angle System OCA (Dataphysics Instruments GmbH, model OCA15). At least ten measurements were performed, and their averages and standard deviations are reported in Table 1. The disclosed ACBC layer of the above acrylic resin and the fluoro component was both chemical resistant and scratch resistant because, it is believed, of its crosslinking nature. The contact angle measurements for the ACBC layers of the Example I and Example II photoconductors indicated that the disclosed ACBC layer (either single layer or two layer) had a lower surface energy (higher contact angle) by about 30 percent, when compared with those of the Comparative Example 1 and Comparative Example 2 (PTFE-doped ACBC) photoconductors, noting that the incorporation of PTFE microparticles (Comparative Example 2) into the ACBC layer did not increase the contact angle.

TABLE 1

| | Contact Angle | Friction Coefficient |
|---|---|---|
| Comparative Example 1 | 83 ± 1° | 0.41 ± 0.01 |
| Comparative Example 2 | 79 ± 2° | 0.40 ± 0.01 |
| Example I | 107 ± 1° | 0.38 ± 0.01 |
| Example II | 107 ± 1° | 0.38 ± 0.01 |

Friction Coefficient Measurements

The coefficients of kinetic friction of the ACBC layers of Comparative Examples 1 and 2, and Examples I and II photoconductors against a polished stainless steel surface were measured by a COF Tester (Model D5095D, Dynisco Polymer Test, Morgantown, Pa.) according to ASTM D1894-63, procedure A. The tester was facilitated with a 2.5"×2.5", 200 gram weight with rubber on one side, a moving polished stainless steel sled, and a DFGS force gauge (250 gram maximum). The photoconductors were cut into 2.5"×3.5" pieces and taped onto the 200 gram weight on the rubber side with the surfaces to be tested facing the sled. The coefficient of kinetic friction is defined as the ratio of the kinetic friction force (F) between the surfaces in contact to the normal force: F/N, where F was measured by the gauge and N is the weight (200 grams). The measurements were conducted at a sled speed of 6"/minute and at ambient conditions. Three measurements were performed for each photoconductor and their averages, and standard deviations are reported in Table 1.

The friction coefficient measurements for the ACBC layers of the Example I and Example II photoconductors indicated that the disclosed ACBC layer had lower surface energy (lower friction coefficient) by about 10 percent when compared with those of the Comparative Example 1 and Comparative Example 2 (PTFE-doped ACBC) photoconductors.

Bulk Resistivity Measurements

The bulk resistivity was measured for the photoconductors with the ACBC layers of Comparative Examples 1 and 2, and the disclosed ACBC layer of Example I. The bulk resistivity measurements were rendered using a Keithley Model 237 High Voltage Source Measure Unit at ambient conditions (~23° C., ~40 percent RH). The samples were electroded with a gold dot on the surface, and the ground plane was exposed on the bottom for both probe contacts. Voltage was swept from about 10 volts to 1,200 volts, and current was measured for each sample. Bulk resistivity was then calculated. This was repeated three times on each sample and averaged for a final result.

The bulk resistivity results are shown in Table 2. The disclosed Example I ACBC layer was about 100,000 fold more conductive than the Comparative Examples 1 and 2 ACBC layers, which indicated that less charge would be accumulated on the Example I ACBC layer with cycling. The disclosed Example I ACBC layer exhibited a 100,000 fold less resistivity, which indicated that whenever there was charge generation on the ACBC surface, the disclosed ACBC layer would dissipate the charge more rapidly than the Comparative Examples 1 and 2 controls, thus resulting in less charge accumulation, or more acceptable antistatic characteristics than the Comparative Examples 1 and 2 controls.

TABLE 2

| | Bulk Resistivity (ohm * cm) |
|---|---|
| Comparative Example 1 | $1.4 \times 10^{15}$ |
| Comparative Example 2 | $9.6 \times 10^{15}$ |
| Example I | $9.4 \times 10^{10}$ |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a substrate, an imaging layer thereon, and a backing layer located on a side of the substrate opposite the imaging layer wherein the outermost layer of the backing layer adjacent to the substrate is comprised of a self crosslinked acrylic resin and a crosslinkable fluoro additive.

2. The photoconductor in accordance with claim 1 wherein said backing layer is a single layer of said self crosslinked acrylic resin, and said crosslinkable fluoro additive, and which layer has a layer thickness of from about 1 to about 30 microns.

3. The photoconductor in accordance with claim 1 wherein said backing layer is comprised of a first and second layer; the first layer being adjacent to said substrate; said first layer being comprised of a polymer selected from a group consisting of polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof with a first layer thickness of from about 1 to about 50 microns; and wherein said second layer is situated on top of said first layer, and which second layer is comprised of said self crosslinked acrylic resin and said crosslinkable fluoro additive, and with a second layer thickness of from about 0.1 to about 30 microns.

4. The photoconductor in accordance with claim 3 wherein said first layer is comprised of a polycarbonate, of a thickness of from about 10 to about 30 microns, and said second layer is of a thickness of from about 1 to about 10 microns.

5. The photoconductor in accordance with claim 1 wherein said backing layer further includes an adhesive layer with a thickness of from about 0.01 to about 1 micron comprised of a material selected from the group consisting of silicone, rubber, and an acrylic resin, and which adhesive layer is situated between the substrate and the backing layer.

6. The photoconductor in accordance with claim 1 wherein said self crosslinked acrylic resin possesses a bulk resistivity of from about $10^8$ to about $10^{14}$ Ωcm, a weight average molecular weight ($M_w$) of from about 100,000 to about 500,000, and a polydispersity index (PDI) ($M_w/M_n$) of from about 1.5 to about 4.

7. The photoconductor in accordance with claim 1 wherein said self crosslinked acrylic resin possesses a bulk resistivity at about 20° C. and about 50 percent humidity of from about $10^9$ to about $10^{12}$ Ωcm, a weight average molecular weight ($M_w$) of from about 120,000 to about 200,000, and a polydispersity index (PDI) ($M_w/M_n$) of about 2 to about 3.

8. The photoconductor in accordance with claim 1 wherein said fluoro additive is a hydroxyl containing perfluoropolyoxyalkane.

9. The photoconductor in accordance with claim 1 wherein said fluoro additive is at least one of hydroxyl containing perfluoropolyoxyalkanes; hydroxyl containing perfluoroalkanes; carboxylic acid containing fluoropolyethers; carboxylic ester containing fluoropolyethers; carboxylic ester containing perfluoroalkanes; sulfonic acid containing perfluoroalkanes; silane containing fluoropolyethers; and phosphate containing fluoropolyethers.

10. The photoconductor in accordance with claim 9 wherein said hydroxyl containing perfluoropolyoxyalkane possesses a weight average molecular weight of from about 200 to about 2,000, a fluorine content of from about 45 to about 65 percent, and a hydroxyl group selected from the group consisting of $—CH_2OH$, $—CH_2(OCH_2CH_2)_nOH$, $—CH_2OCH_2CH(OH)CH_2OH$, and mixtures thereof; said carboxylic acid fluoropolyether possesses a molecular weight of from about 200 to about 2,000, and a fluorine content of from about 45 to about 75 percent; said carboxylic ester perfluoroalkane possesses a molecular weight of from about 200 to about 2,000, a fluorine content of from about 45 to about 75 percent, and is represented by $R_fCH_2CH_2O(C{=}O)R$, wherein $R_f{=}F(CF_2CF_2)_n$ and R is alkyl; said sulfonic acid perfluoroalkane possesses a molecular weight of from about 200 to about 2,000, a fluorine content of from about 45 to about 75 percent, and is represented by $R_fCH_2CH_2SO_3H$, wherein $R_f{=}F(CF_2CF_2)_n$; said silane fluoropolyether possesses a molecular weight of from about 1,000 to about 3,000, and said phosphate fluoropolyether possesses a weight average molecular weight of from about 1,500 to about 5,000, wherein n represents the number of repeating groups.

11. The photoconductor in accordance with claim 1 wherein said self crosslinked acrylic resin is present in an amount of from about 60 to about 99.9 weight percent, and said fluoro additive is present in an amount of from about 0.1 to about 40 weight percent, and wherein the total thereof is about 100 percent.

12. The photoconductor in accordance with claim 1 wherein said backing layer further includes an acid catalyst selected in an amount of from about 0.01 to about 5 weight percent.

13. The photoconductor in accordance with claim 12 wherein said acid catalyst is a toluenesulfonic acid selected in an amount of from about 0.1 to about 2 weight percent.

14. The photoconductor in accordance with claim 1 wherein said imaging layer is comprised of a photogenerating layer, and at least one charge transport layer comprised of at least one charge transport compound.

15. The photoconductor in accordance with claim 14 wherein said charge transport compound is comprised of at least one of aryl amine molecules

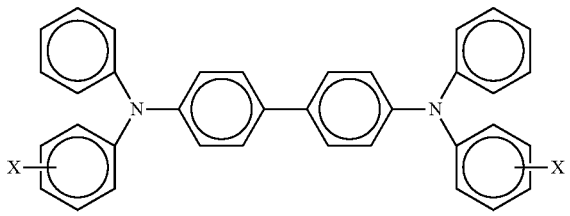

and

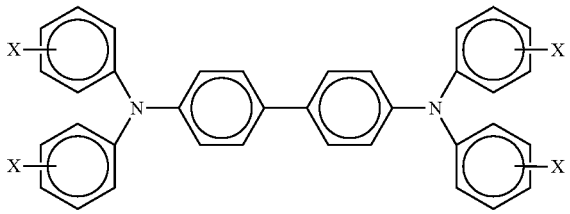

wherein X is selected from the group consisting of at least one of alkyl, alkoxy, aryl, and halogen.

16. The photoconductor in accordance with claim 14 wherein said charge transport compound is comprised of

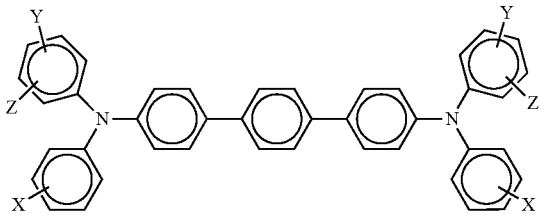

wherein X, Y and Z are independently selected from the group consisting of at least one of alkyl, alkoxy, aryl, and halogen.

17. The photoconductor in accordance with claim 14 wherein said charge transport compound is an aryl amine compound selected from the group consisting of N,N'-diphenyl-N,N'-bis(alkylphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terpheny]-4,4'-diamine, N,N'-bis(4-butylphenyl)-N,N'-bis-(2-ethyl-6-methylphenyl)-[p-terphenyl]4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]4,4'-diamine, and optionally mixtures thereof.

18. The photoconductor in accordance with claim 14 wherein said charge transport compound is comprised of aryl amine mixtures, and said crosslinked acrylic resin has a weight average molecular weight of from about 120,000 to about 200,000; a polydispersity index (PDI) ($M_w/M_n$) of from about 1.5 to about 4 or from about 2 to about 3; and a bulk resistivity of from about $10^8$ to about $10^{14}$ Ωcm, and wherein said crosslinkable fluoro additive possesses a weight average molecular weight of from about 200 to about 1,000, a fluorine content of from about 55 to about 80 percent, and is represented b $R_fCH_2CH_2OH$, wherein $R_f$ is $F(CF_2CF_2)_n$ and n is from about 1 to about 50.

19. The photoconductor in accordance with claim 14 wherein said imaging layer further includes in at least one of said charge transport layers an antioxidant comprised of a hindered phenolic and a hindered amine.

20. The photoconductor in accordance with claim 14 wherein said photogenerating layer is comprised of a photogenerating pigment or photogenerating pigments.

21. The photoconductor in accordance with claim 20 wherein said photogenerating pigment is comprised of at least one of a metal phthalocyanine, metal free phthalocyanine, a perylene, and mixtures thereof.

22. The photoconductor in accordance with claim 1 further including a hole blocking layer, and an adhesive layer, and wherein said substrate is comprised of a conductive material.

23. The photoconductor in accordance with claim 14 wherein said at least one charge transport layer is from 1 to about 4 layers, and wherein said self crosslinked acrylic resin possesses a weight average molecular weight of from about 120,000 to about 200,000, a polydispersity index (PDI) ($M_w/M_n$) of from about 2 to about 3, and a bulk resistivity of from about $10^9$ to about $10^{12}$ Ωcm and wherein said crosslinkable fluoro additive is hydroxyl containing perfluoropolyoxyalkane.

24. The photoconductor in accordance with claim 1 wherein said substrate is a flexible web.

25. The photoconductor in accordance with claim 1 wherein the weight/weight ratio of said self crosslinked acrylic resin and the crosslinkable fluoro additive component in the backing layer is from about 99.9/0.1 to about 50/50.

26. The photoconductor in accordance with claim 1 wherein weight/weight ratio of the self crosslinked acrylic resin, and the crosslinkable fluoro additive component in the backing layer is from about 99.5/0.5 to about 80/20 or from about 99/1 to about 90/10.

27. The photoconductor in accordance with claim 9 wherein said hydroxyl containing perfluoroalkane possesses a weight average molecular weight of from about 200 to about 1,000, a fluorine content of about 55 to about 80 percent, and is represented by $R_fCH_2CH_2OH$, wherein $R_f$=$F(CF_2CF_2)_n$ and n is from about 1 to about 50.

28. A photoconductor comprised of a single backing layer, thereover a supporting substrate, a photogenerating layer, a charge transport layer, and wherein said backing layer is comprised of a crosslinked acrylic resin and a crosslinked fluoro additive said crosslinked acrylic resin having a weight average molecular weight of from about 100,000 to about 500,000.

29. A photoconductor comprised of a first backing layer and thereover a second backing layer; in sequence thereover a supporting substrate, a photogenerating layer, a charge transport layer, and wherein the first layer of said backing layer is adjacent to said substrate and is comprised of a polycarbonate, and the second layer of said backing layer is situated on top of the first layer, and is comprised of a self crosslinked acrylic resin, a crosslinkable fluoro additive, and an acid catalyst.

* * * * *